US011066218B2

(12) United States Patent
Baumann et al.

(10) Patent No.: US 11,066,218 B2
(45) Date of Patent: Jul. 20, 2021

(54) DISCHARGE HEAD, AND LIQUID DISPENSER COMPRISING SUCH A DISCHARGE HEAD

(71) Applicant: APTAR RADOLFZELL GMBH, Radolfzell (DE)

(72) Inventors: Tobias Baumann, Constance (DE); Thomas Bruder, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 16/348,067

(22) PCT Filed: Nov. 10, 2017

(86) PCT No.: PCT/EP2017/078936
§ 371 (c)(1),
(2) Date: May 7, 2019

(87) PCT Pub. No.: WO2018/091376
PCT Pub. Date: May 24, 2018

(65) Prior Publication Data

US 2019/0308780 A1 Oct. 10, 2019

(30) Foreign Application Priority Data

Nov. 17, 2016 (EP) ..... 16199378

(51) Int. Cl.
*B65D 47/18* (2006.01)
*B05B 11/00* (2006.01)
(Continued)

(52) U.S. Cl.
CPC ..... *B65D 47/18* (2013.01); *B05B 11/0062* (2013.01); *B05B 11/3073* (2013.01); *B65D 47/0804* (2013.01); *B65D 47/2031* (2013.01)

(58) Field of Classification Search
CPC ... B05B 11/04; B05B 11/0062; B05B 11/007; B05B 11/0073; B05B 11/0075;
(Continued)

(56) References Cited

U.S. PATENT DOCUMENTS 2,603,397 A * 7/1952 Olson ..... G01F 11/32 141/292
3,141,579 A * 7/1964 Medlock ..... G01F 11/286 222/207
(Continued)

FOREIGN PATENT DOCUMENTS

CN 1071888 A 5/1993
CN 2298214 Y 11/1998
(Continued)

OTHER PUBLICATIONS

Office Action from the Chinese Patent Office corresponding to Chinese Patent Application No. 201780071303.4, with relevant portions in English, dated Apr. 3, 2020 (11 pages).
(Continued)

*Primary Examiner* — Paul R Durand
*Assistant Examiner* — Randall A Gruby
(74) *Attorney, Agent, or Firm* — Flynn Thiel, P.C.

(57) ABSTRACT

Discharge head for a liquid dispenser including a housing, a coupling device for attachment to a liquid store, a discharge opening through which liquid is dispensed and an outlet channel extending from an inlet region, pointing in the direction of the liquid store, up to the discharge opening and via which the discharge opening is supplied with liquid. A throttle device is arranged in the outlet channel and includes a throttle channel for reducing liquid pressure and/or liquid flow through the throttle device. The throttle device is designed in the form of a dynamic throttle device, in which a free cross section of the throttle channel is reduced in size
(Continued)

with increasing pressure prevailing at the throttle device, or with greater liquid flow flowing through the throttle device.

27 Claims, 11 Drawing Sheets

(51) Int. Cl.
*B65D 47/08* (2006.01)
*B65D 47/20* (2006.01)

(58) Field of Classification Search
CPC .... B65D 47/18; B65D 47/08; B65D 47/0804; B65D 47/2031
USPC ..... 222/212, 213, 490, 494, 422
See application file for complete search history.

(56) References Cited

U.S. PATENT DOCUMENTS 3,828,985 A * 8/1974 Schindler ..... A47K 5/1211 222/207
4,506,809 A * 3/1985 Corsette ..... B65D 47/2081 222/213
4,877,624 A * 10/1989 Floyd ..... A23L 3/10 426/241
5,074,440 A * 12/1991 Clements ..... B05B 11/047 222/189.09
5,275,312 A * 1/1994 Labruzzo ..... B05B 11/0064 137/540
5,680,969 A * 10/1997 Gross ..... B65D 47/242 222/494
5,687,882 A * 11/1997 Mueller ..... B65D 47/2081 222/212
5,803,311 A * 9/1998 Fuchs ..... B05B 1/3436 222/105
5,904,275 A * 5/1999 Suffa ..... B65D 47/2037 222/494
5,944,234 A 8/1999 Lampe et al.
6,095,382 A * 8/2000 Gross ..... B65D 47/242 215/271
6,126,037 A * 10/2000 Lifshey ..... B65D 51/222 222/1
6,250,503 B1 * 6/2001 Dark ..... B65D 47/2018 222/1
6,269,986 B1 * 8/2001 Gross ..... B65D 47/0804 222/541.5
6,415,961 B2 * 7/2002 Bonningue ..... G01F 11/04 222/205
6,523,711 B1 2/2003 Hughes et al.
6,543,652 B1 * 4/2003 Kelder ..... B65D 47/2037 222/212
6,616,012 B2 * 9/2003 Dark ..... B65D 47/2081 222/1
6,672,479 B2 * 1/2004 Shiraishi ..... B65D 23/02 222/105
6,968,976 B2 * 11/2005 Masuda ..... B65D 47/2075 222/494
6,974,053 B2 * 12/2005 Lautre ..... B65D 47/2081 222/92
7,681,750 B2 * 3/2010 Jackel ..... B65D 47/2037 215/235
7,784,652 B2 * 8/2010 Gaus ..... B65D 47/2031 222/494
7,971,755 B2 * 7/2011 Faurie ..... B65D 47/18 222/189.09
8,490,839 B2 * 7/2013 Mihashi ..... B65D 51/1616 222/189.06
8,505,188 B2 * 8/2013 Lenz ..... B65D 47/0838 29/527.1
8,528,791 B2 * 9/2013 Fernandez de Mendiola Quintana ..... B65D 47/0838 222/213
8,596,501 B2 * 12/2013 Hagleitner ..... A47K 5/13 222/207
8,608,034 B2 * 12/2013 Bloom ..... B65D 51/18 222/490
8,740,023 B2 * 6/2014 Geiger ..... B65D 47/2025 222/494
8,851,333 B2 * 10/2014 van de Poll ..... B05B 11/3067 222/207
9,682,804 B2 * 6/2017 Hatton ..... B65D 47/2025
9,815,599 B2 11/2017 Spiegelhoff et al.
10,173,815 B2 * 1/2019 Greiner-Perth ..... B65D 50/04
10,179,680 B2 * 1/2019 Kim ..... B65D 47/121
2006/0111680 A1 5/2006 Spada et al.
2007/0093765 A1 * 4/2007 Kawashiro ..... B65D 47/18 604/295
2011/0009836 A1 * 1/2011 Chebli ..... A61F 9/0008 604/298
2011/0089191 A1 * 4/2011 Altonen ..... G01F 11/288 222/1
2011/0144598 A1 * 6/2011 Mihashi ..... B65D 47/18 604/295
2011/0301572 A1 * 12/2011 Vlodaver ..... A61M 31/00 604/514
2012/0114800 A1 * 5/2012 McKay ..... A23L 33/10 426/72
2013/0026191 A1 * 1/2013 Duquet ..... B05B 11/309 222/256
2013/0126561 A1 * 5/2013 Smith ..... B65D 51/002 222/494
2014/0151404 A1 * 6/2014 Lehmkuhl ..... B65D 41/0471 222/153.14
2014/0231462 A1 * 8/2014 Ray ..... A47K 5/122 222/207

FOREIGN PATENT DOCUMENTS

DE 4403080 A1 8/1995
DE 202016102192 U1 9/2016
EP 2003069 A2 12/2008
EP 3081111 A1 10/2016
WO 2006058011 A1 6/2006
WO 2006/078370 A1 7/2006
WO 2009/079753 A1 7/2009
WO 2016/164007 A1 10/2016

OTHER PUBLICATIONS

International Search Report issued in International Application No. PCT/EP2017/078936 with English translation, dated Jan. 15, 2018 (5 pages).
Written Opinion of International Searching Authority issued in International Application No. PCT/EP2017/078936 dated Jan. 15, 2018 (5 pages).
Search Report of European Patent Office issued in European Application No. 16 19 9378 with English translation of category of cited documents dated May 16, 2017 (6 pages).

* cited by examiner

Fig. 11A
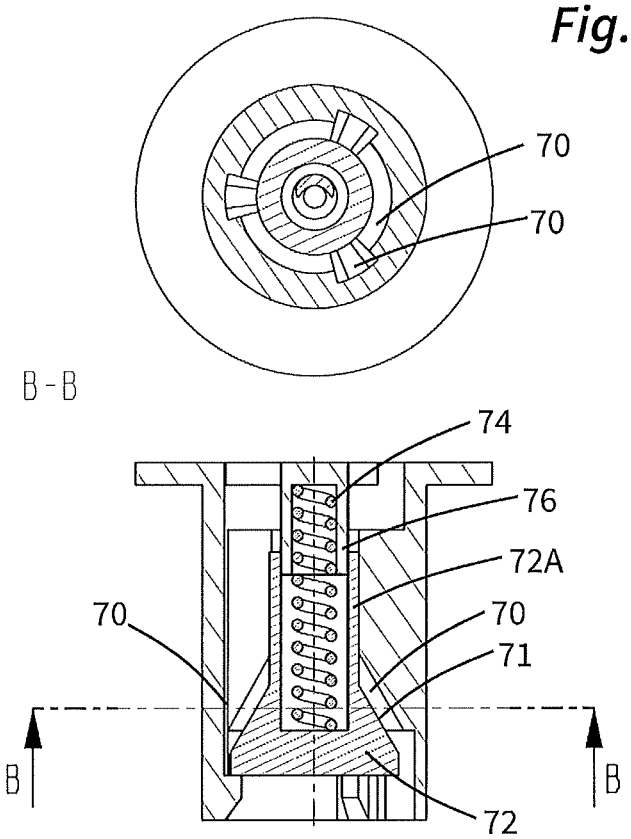
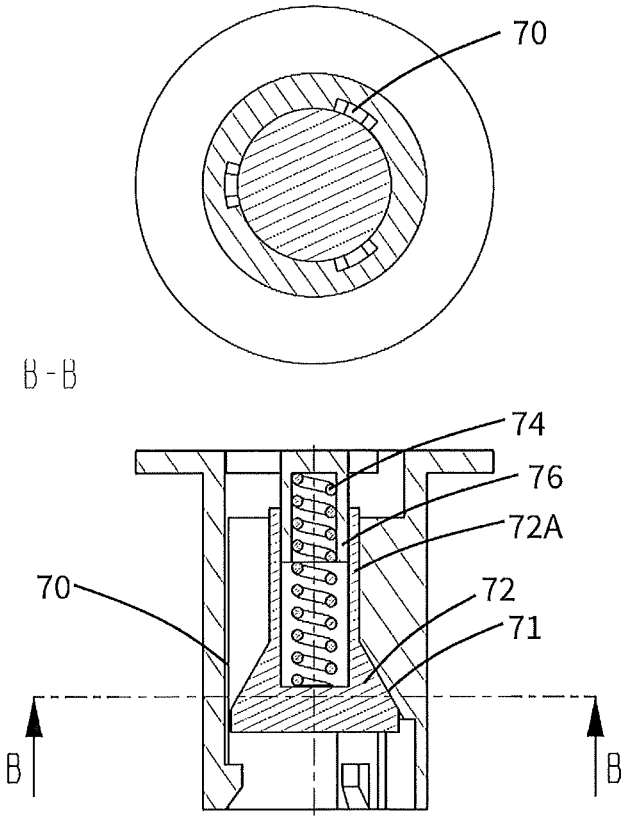
Fig. 11B

DISCHARGE HEAD, AND LIQUID DISPENSER COMPRISING SUCH A DISCHARGE HEAD

FIELD OF APPLICATION AND PRIOR ART

The invention relates to a discharge head for a liquid dispenser, and to a liquid dispenser with such a discharge head.

A discharge head of the type in question has a housing and a coupling device for attachment to a liquid store. It also has a discharge opening through which liquid is able to be dispensed into a surrounding atmosphere, and an outlet channel which extends from an inlet region, pointing in the direction of the liquid store, up to the discharge opening and by means of which the discharge opening is able to be supplied with liquid.

With a dispenser of the type in question and a discharge head of the type in question, it is provided that the liquid in the liquid store, or in a pressure chamber separate therefrom, is subjected to pressure in order to be conveyed by way of this pressure through the outlet channel in the direction of the discharge opening. However, according to the manner of the pressure application, it is possible for a user to influence the pressure directly and thus, in light of the application purpose, also to subject the liquid to an excessive pressure, for example by the force with which a squeeze bottle, serving as a liquid store, is compressed.

The effect of this user-dependent pressure application can then be for example that a liquid jet is released at the discharge opening, although only a small quantity of liquid for forming drops should be dispensed. Alternatively, a pressure can be generated, which leads to a spray pattern with excessively fine droplets.

In order to limit the liquid pressure and/or the liquid flow, it is possible to provide in the outlet channel a geometry which acts as a throttle, for example a channel section with a very small cross section and/or a relatively large length. Due to the friction established here, it is possible to reduce the liquid pressure/the liquid flow. However, the effect of such a throttle is then that the actuation always has to be realized by a fairly large force. This may not be a problem for some application purposes. However, specifically with application purposes in which a positionally accurate release of the liquid is desired, for example during the application of eye drops or the application with pinpoint accuracy of make-up, it is desirable that a relatively gentle actuation is enough to be able to bring about the desired discharge process.

Problem and Solution

The problem addressed by the invention is to provide a discharge head and a liquid dispenser, which, even when subjecting the liquid to low pressure, are able to release said liquid through the discharge opening in the manner as intended, but at the same time, if actuation is too intense, limit the liquid pressure and/or the liquid flow such that an intended form of release of the liquid remains possible.

For this purpose, it is provided that the discharge head has, in the outlet channel, a throttle device with a throttle channel for the reduction in the liquid pressure and/or the liquid flow of the liquid flowing through the throttle device.

According to the invention, said throttle device is designed in the form of a dynamic throttle device, in which a free cross section of the throttle channel is reduced in size with increasing pressure prevailing at the throttle device, or with greater liquid flow flowing through the throttle device.

Just like a discharge head of the type in question, a discharge head according to the invention has an outlet channel at whose end the exit opening is provided. Said outlet channel connects a liquid store of the liquid dispenser to the discharge opening such that, when the liquid in the liquid store is subjected to pressure as a whole or else a partial amount of the liquid is subjected to pressure, this is conveyed in the direction of the discharge opening and released there.

In order to avoid an excessively high pressure and/or an excessive liquid flow at the discharge opening, the stated dynamic throttle device is provided. Said dynamic throttle device has the special feature that it adapts the flow resistance in dependence on actuation parameters. This is realized in that a free cross section of the throttle channel is reduced in size with higher pressure or greater liquid flow. Such a reduction may for example consist in that, beyond a first throttle location, a further throttle location is formed in the outlet channel by displacing a throttle surface, the free cross section of which further throttle location is less than that of the first throttle location. In particular, however, a wall of the throttle channel can undergo a displacement such that, in this way, the throttle channel reduces in size its free cross section.

In the simplest case, it is possible for the dynamic throttle device to be designed such that it normally only assumes one of two possible states, a non-throttling or barely throttling state and a more highly throttling state. A design in which the throttling effect comes into being in an, as it were, analog manner, such that, with increasing application of pressure or increasing liquid flow, a continuously increasing throttling effect is obtained, is preferable however. Although a configuration of the dynamic throttling device in which it completely closes with excessively high pressure is not ruled out, it is considered to be advantageous for the dynamic throttling device to be designed such that it never completely closes the throttling channel.

The dynamic throttle device is adapted as intended in dependence on operating parameters in each case, specifically in dependence on the prevailing pressure or on the liquid flow, wherein, according to the configuration, the two stated variables are coupled to one another or in each case bring about adaptation of the dynamic throttle device. A configuration of the throttle device which, directly by pressure, leads to a reduction in size of the free cross section of the throttle channel may be provided for example if differently sized pressure application surfaces on a displaceable wall of the throttle channel ensure that increasing pressure brings about a deflection of said wall. The liquid flow can also bring about the displacement of a channel wall of the throttle channel if an identical total pressure prevails on both sides of said wall, since the increased liquid speed in the throttle channel, in accordance with Bernoulli's principle, leads to a lower static pressure there, this in turn being able to be used to narrow the throttle channel.

The throttle channel is delimited, at least in sections, by an inner side of a channel wall whose position is able to be varied by displacement or deformation.

In the case of the throttle channel being varied by displacement of a channel wall, it is preferably provided that said channel wall is inherently rigid and part of a throttle component which is displaced as a whole. This will be discussed in more detail below.

In the case of the throttle channel being delimited by a deformable channel wall, it is provided that a deformable and preferably elastic component, which is subsequently thereby able to return to its initial position, is used in order to bring about a variable cross section of the throttle channel.

An outer side of the channel wall, which faces away from the inner side, is able to be connected in a communicating manner to an inlet of the throttle channel such that, when the liquid is subjected to pressure for the purpose of discharge, an identical pressure increase is realized at the inlet of the throttle channel and at the outer side of the channel wall.

A configuration in which an identical total pressure is established on both sides of the channel wall is advantageous since the cross section of the throttle channel is made to vary not by the pressure application of the liquid as such, but rather only by the increase in the dynamic pressure and the drop in the static pressure in the throttle channel. The dynamic pressure arises owing to the speed of the liquid flow in the throttle channel. Since it is normally the aim to limit the liquid flow in a configuration according to the invention of a discharge head, a solution in which it is also the case that the liquid flow and its speed directly constitute that variable which leads to narrowing of the throttle channel and thereby to an increase in the friction with respect to the walls and within the liquid and consequently to a reduction in the liquid flow is advantageous. To a certain extent, the liquid flow itself is thereby directly limited.

The positionally variable channel wall may be part of a planar and preferably deformable wall plate. A positionally fixed channel wall may be provided opposite said channel wall, the latter being at least partially positionally variable with respect to the housing, wherein the positionally variable channel wall and the positionally fixed channel wall define the throttle channel between them.

This design has turned out to be very simple and reliable. In this case, the throttle channel is formed by a gap between the non-deformed planar wall plate and the channel wall which is positionally fixed with respect to the housing. The planar and preferably deformable wall plate is preferably fastened in a manner positionally fixed with respect to the positionally fixed channel wall in a fastening region and projects over said positionally fixed channel wall so as to form the gap. It is advantageous in particular if the positionally fixed channel wall furthermore has at least one aperture, which constitutes the end of the throttle channel, as it were, and into which the liquid which has passed through the throttle channel flows. A particularly simple possibility for fastening the planar and preferably deformable wall plate is for this to be provided with an aperture, which is pushed onto a housing-side fastening pin and is fastened, for example snap-fitted, there.

The discharge head may have multiple throttle channels, which are connected in parallel with respect to one another. The wall plate may in this case be provided as a common wall plate, which delimits the at least two throttle channels in sections.

Although one throttle channel is naturally sufficient for achieving the desired purpose, it can advantageously and, in terms of construction, very easily be possible to provide multiple throttle channels which are connected in parallel. Parallel connection is to be understood as meaning that the liquid has to pass through only one of these throttle channels connected in parallel. The arrangement in which a common wall plate delimits both throttle channels in sections leads to a reduction of components and is also very simple to achieve by a point—or line-symmetrical configuration. In this regard, the wall plate can be fastened between the throttle channels in the region of a web, and deform as intended on both sides of said web to bring about narrowing of the two throttle channels provided there. Depending on the specific application purpose, for the purpose of adapting the throttling behavior, it can also be expedient for more than two throttle channels, in particular four throttle channels, to be provided. At least one elevation may be provided on the housing wall or the wall plate, in the region of which the housing wall and the wall plate bear against one another.

A gap which constitutes the throttle channel is defined by the housing wall and the wall plate in a manner already stated. Said gap is additionally delimited by the stated elevations or the edges thereof. The housing wall and the wall plate bear against one another in the region of the elevations, wherein it is advantageous in particular if the elevations are provided on sides of the housing wall since it is then possible for the deformable wall plate to be designed as a wall plate of elevation-free, planar form, which is thus inexpensive to produce.

The elevations and in particular the edges of these elevations, which at the same time form the edges of the throttle channel, may be used in a simple manner in order to influence the tendency of the wall plate for throttling deformation. If, for example, a rectilinear web-like elevation is provided, then, for the purpose of deforming the wall plate fastened in the region of this elevation, it is necessary for the wall plate to be bent in, following the web-like elevation, merely once. However, if there are provided elevations whose edges pointing in the direction of the throttle channel include an angle of less than 180°, for example an angle of approximately 90°, then it is necessary for the wall plate to bend in along two non-parallel lines for the purpose of the deformation, this requiring a greater degree of force application. It is in particular also possible for the shape of the elevations to be used in order to adapt otherwise structurally identical discharge heads to different liquids and the specific properties thereof or to be able to influence the maximum discharge pressure/discharge liquid flow in the light of the field of application.

As an alternative to the design described, in which the throttle channel is delimited by a positionally fixed and preferably rigid wall and a positionally variable wall, it may also be provided that the discharge head has a throttle component composed of an elastically deformable material as part of the throttle device. Said throttle component has an aperture which is surrounded by a deformation region and which forms the throttle channel.

The throttle component additionally preferably has at least one pressure application surface, against which, during operation, the liquid bears upstream of the throttle channel and by way of whose pressure application the deformation region is deformed and a free cross section of the throttle channel is able to be reduced in size.

With this alternative design, it is provided that the throttle channel is provided in the form of an aperture, which is surrounded in an encircling manner, at a throttle component which is deformable as a whole, wherein the regions surrounding this aperture, that is to say the throttle channel, form the deformation region and are able to be deformed by pressure application, or a liquid flow, such that the free cross section of the throttle channel is varied.

Since, with such a design, the throttle channel is defined by one component alone, it is possible to achieve very low variation in the characteristics of structurally identical discharge heads. By contrast to a design in which the throttle channel is formed by multiple components, with this design, there is barely any dependence on a particular assembly accuracy.

Added to this is the fact that the assembly is very simple owing to the configuration of the throttle channel from merely one component.

The throttle component may have an elevation which is bulged in the upstream direction and in which the throttle channel is provided. In this way, it is achieved that the narrowing, provided as desired, of the throttle channel is reliably established if the liquid pressure is applied to the elevation from different sides. The throttle channel preferably penetrates the elevation at the most elevated point thereof.

The throttle component may have an encircling edge region on the outside, which is integrally connected to the deformation region.

In the region of said edge, the elastic throttle component may be fastened to a rigid housing section of the housing by way of a snap-action connection or in particular an integral formation.

The fastening of the throttle component to a housing section of the housing of the discharge head is advantageous since, in this way, a pre-assembly unit which, even when handled as a bulk good, does not run the risk of damage to the elastic throttle component is provided. Said throttle component is preferably set back with respect to walls of the housing such that, handled as a bulk good, it is not damaged by other discharge heads of the bulk good. This has turned out to be advantageous in practice since otherwise there is the risk that the throttle component no longer responds in a throttling manner in the desired way after being damaged as a bulk good.

Of particular advantage is the integral formation in which, preferably by two-component injection molding, the stated rigid housing section and the elastic throttle component are produced integrally from different materials. The number of the components to be joined during the course of an assembly can be reduced in this way. Moreover, a highly precise and permanent positioning of the throttle component relative to the housing is consequently ensured.

The edge region may be arranged such that, when the liquid store is coupled, it seals off the liquid store with respect to the housing. As a result of this use of the edge region of the throttle component as a seal between the discharge head and the liquid store, it is possible to dispense with a separate component therefor. The discharge head can therefore be produced with very few components and correspondingly little effort in terms of assembly.

In one particular configuration, the throttle channel may have at least one closure region and at least one free region, which regions form the cross section of the throttle channel jointly and so as to merge into one another. In the closure region, opposite edges of the throttle channel come to bear against one another as a result of the pressure application surface being subjected to force. The free region is delimited by an edge arrangement which does not lead to closure of the free region even when the pressure application surface is subjected to force.

The stated design accordingly provides that the throttle channel has a cross-sectional area which has a pressure- or liquid flow-dependent sub-region, the closure region, which closes with high pressure or with a large liquid flow. Moreover, however, there is also provided a free region which, even in the case of the greatest pressures and liquid flows to be assumed during real operation, remains open.

It is thus ensured that, even in the case of high pressures, a complete closure of the throttle channel does not take place. This corresponds to the desire for a discharge in the case of excessively intense application of force not to be prevented but to be dampened to the extent that the desired discharge pattern is established.

As a result of the joint realization of the closure region and the free region as part of the cross section of the same throttle channel, it is also achieved that, after narrowing of the throttle channel by closure of the closure region, the tendency of the closure region to re-open after the closing pressure has subsided is promoted. This is advantageous specifically in view of the fact that it is also intended for it to be possible for tacky material to be discharged by means of the discharge head according to the invention.

The design in sections of the throttle channel as a closure region or as a free region can be determined by the selection of the geometry. In this regard, a slot-shaped section of the cross section of the throttle channel is suitable for complete closure and thus to constitute a closure region. However, a circular or polygonal portion of the throttle channel does not completely close, even with high pressures, and thus constitutes a free region.

Although it is considered to be advantageous to design a combined throttle channel having such a closure region and a free region, also conceivable is a design in which two channels connected in parallel jointly form a throttle channel arrangement, wherein one of these channels has a free region while the other channel completely closes in a pressure- or liquid flow-dependent manner. Such a design can also be expedient in particular in the case of liquids which do not promote the lasting adhesion of opposite edges or walls of the throttle channel.

As an alternative to the design described, in which the throttle channel is preferably delimited in sections by at least one wall which varies in shape, it is provided in a further variant that the throttle channel is delimited by two rigid channel walls, wherein one of the channel walls is provided as a positionally variable channel wall on a positionally variable throttle component.

With this design, the throttle channel is delimited by rigid walls which are movable as a whole relative to one another. At least one of these walls is able to be deflected, preferably counter to the force of a restoring spring, wherein the free cross section of the throttle channel is reduced in size by way of said deflection.

Said positionally variable throttle component is preferably guided with respect to the housing by means of a guide, wherein said guide may be formed in particular by two sleeves which are slid telescopically one inside the other. Said spring force is preferably generated by a spring device which, with a particularly advantageous design, is arranged in the free space formed by the sleeves.

It is of particular advantage if the throttle component is designed such that, and/or is attached to the housing such that, pressure application surfaces on the throttle component which are active for displacement cause, with identical pressure on all pressure application surfaces, the throttle component to be subjected to force in a direction in which the free cross section of the throttle channel is reduced in size. This means that the static pressure alone, which is applied for the purpose of discharge, is able to displace the throttle component in terms of narrowing the throttle channel.

Preferably, the discharge head has, in the outlet channel downstream of the throttle device, an outlet valve which opens in dependence on the positive pressure prevailing upstream.

Such a valve leads to the risk of egress from the dispenser being reduced. However, since it is in particular intended for a drop dispenser based on a discharge head according to the invention to be realizable, it is particularly advantageous if the valve already opens at a low positive pressure of, for example, 0.3 bar.

The outlet valve preferably closes automatically in a pressure interval between a defined inlet-side negative pressure and an inlet-side positive pressure and opens when the defined negative pressure is exceeded and when the defined positive pressure is exceeded. Consequently, such a valve opens both with negative pressure and with positive pressure. This is the prerequisite for simultaneous use of the outlet channel as an aeration channel for the liquid store. This is advantageous in terms of simple construction. Moreover, a particular advantage in using the outlet channel jointly as an aeration channel too is that the throttle channel is able to be widened again by the incoming air after a discharge process has ended.

This is also supported in that such bidirectional behavior also makes it possible for the negative pressure prevailing in the liquid store after the dispensing to suck the liquid back from the outlet channel too, with the result that drying-on in the region of the outlet channel beyond the valve is prevented.

The outlet valve is preferably formed from an elastic material and has a bulge which is directed upstream and in which a valve opening, which is able to be closed by valve lips, is provided such that, with increasing inlet-side positive pressure, the valve lips are increasingly pressed against one another by the positive pressure up to the attainment of an inlet-side limit pressure for positive pressure.

The discharge head is preferably designed for the formation of drops, wherein the throttle device is designed for a limitation of the liquid flow, which leads to the formation of single drops, and not to the formation of a liquid jet, at the discharge opening.

In the case of such drop dispensers in particular, prevention of excessive liquid flow and/or excessive discharge pressure is relevant, since this counteracts drop formation and can lead to an unintended jet at the discharge opening. The throttle device is preferably adapted to the configuration of a drop formation surface, arranged beyond the outlet opening, such that the liquid flow at the discharge opening is not sufficient to allow a continuous separation of the liquid flow, that is to say a jet.

Preferably, the housing of the discharge head comprises a first, integral base component, which comprises the coupling device for attachment to the liquid store, and a second, integral applicator component, which has the discharge opening and is penetrated by the liquid channel and is fastened to the base component.

The stated design with merely two components at the housing is very inexpensive owing to the simplicity thereof. Moreover, the two housing components, the base component and the applicator component, make it possible for the stated outlet value to be positionally fixed in a simple manner. If the throttle component is, in the manner outlined above, designed in the form of an elastic component which is formed integrally with a housing section, in particular from the base component, then it is possible for a complete discharge head to be assembled from merely three components to be assembled.

Likewise provided for the solution of the invention is a liquid dispenser for dispensing liquid, in particular for dispensing cosmetic or pharmaceutical liquids, which has a discharge head with an outlet opening for dispensing of liquid into a surrounding atmosphere, and which has a liquid store, which is connected to a housing of the discharge head by way of a detachable coupling device or an integral formation.

In this case, the discharge head is designed as claimed in one of the preceding claims.

In this case, the liquid dispenser is preferably designed in the form of a drop dispenser. There is thus provided beyond the discharge channel a drop formation surface, preferably in the form of a spherical cap, at which the liquid is gathered before it is detached in drop form. Said drop formation surface, the throttle device and the liquid in the dispenser are preferably matched to one another such that, even with a high actuation force applied to the squeeze bottle of 100 newtons, a liquid jet does not form at the discharge opening.

The liquid store is preferably designed in the form of a squeeze bottle or tube. With such a design of the liquid store in the form of a squeeze bottle or tube in particular, there is the risk that excessively intense actuation is realized by the user, and so the dynamic throttle device which has been described here is particularly helpful for preventing said excessively intense actuation from adversely influencing the discharge pattern.

The inner volume of the liquid dispenser is preferably less than 300 ml, less than 100 ml, or, even, less than 50 ml. These are typical sizes of liquid stores for holding pharmaceutical or cosmetic liquids.

The liquid store is preferably filled with a cosmetic or pharmaceutical liquid. As pharmaceutical liquids, liquids carrying preservatives are possible in particular, since it is considered to be advantageous if, with a discharge head according to the invention, the aeration is realized through the outlet channel, so that it is difficult here for air filtering to be realized in a structural sense. In the area of cosmetic liquids, make-up products and creams, such as for example anti-wrinkle cream and oils, which are in particular intended to be discharged. In particular, so-called filler or concealer liquids, which serve for filling or covering relatively small wrinkles, can be dispensed well with a discharge head according to the invention.

BRIEF DESCRIPTION OF THE DRAWINGS

Further advantages and aspects of the invention will emerge from the claims and from the following description of preferred exemplary embodiments of the invention, which are discussed below on the basis of the figures.

FIGS. 11A and 11B show the throttle device of the exemplary embodiment in FIG. 10 with different states of the throttle channel.

DETAILED DESCRIPTION OF THE EXEMPLARY EMBODIMENTS

Figure 1:
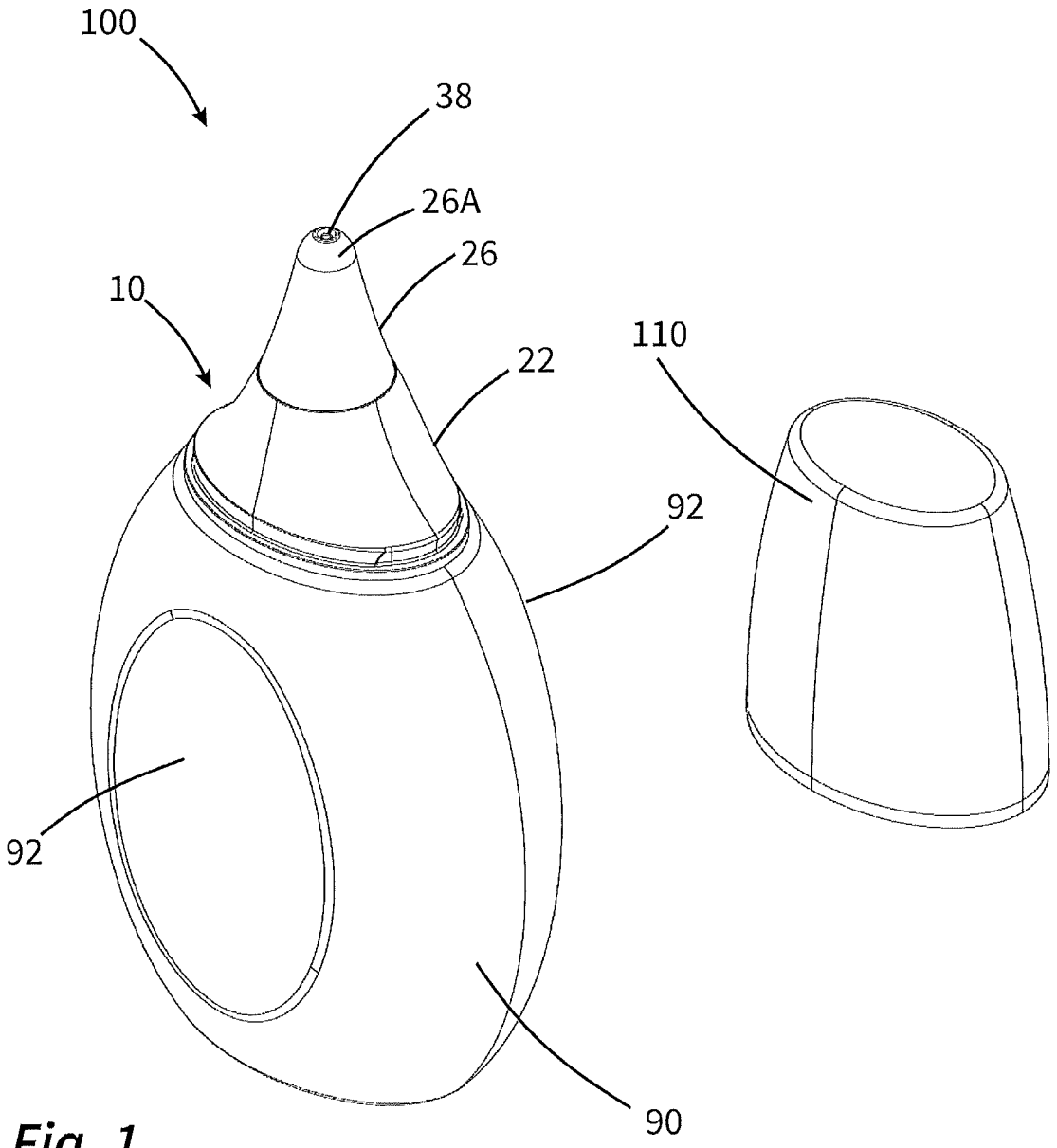
FIG. 1 shows, in an overall illustration from the outside, a liquid dispenser according to the invention with a discharge head according to the invention.

FIG. 1 shows a liquid dispenser 100 according to the invention, which is designed in the manner of a drop dispenser.

Said liquid dispenser 100 has a liquid store 90, which is designed in the form of a squeeze bottle, and a discharge head 10 mounted thereon, at which a discharge opening 38 is provided. To close the liquid dispenser, a cap 110 is provided.

The liquid dispenser serves for releasing, in drop form, drops, for example of cosmetic liquids such as oils, make-up, filler or the like. In this case, for actuation as intended, the entire dispenser is positioned more or less upside down, with the discharge opening 38 pointing downward, and, in this position, the liquid store 90 is, on opposite sides in the region of actuation surfaces 92, subjected to force and compressed such that the liquid contained in the liquid store is subjected to pressure and is conveyed to the discharge opening 38. Here, the liquid is gathered at a drop formation surface 26A, which surrounds the discharge opening 38, and, as intended, is detached in the form of individual drops.

The technical design, discussed below, of the discharge head 10 serves the purpose of ensuring both that pressing the squeeze bottle only lightly is enough for drop release drop, and that, also, actuating, or compressing, the liquid store 90 intensely does not lead to liquid being released in the form of a liquid jet.

Figure 2:
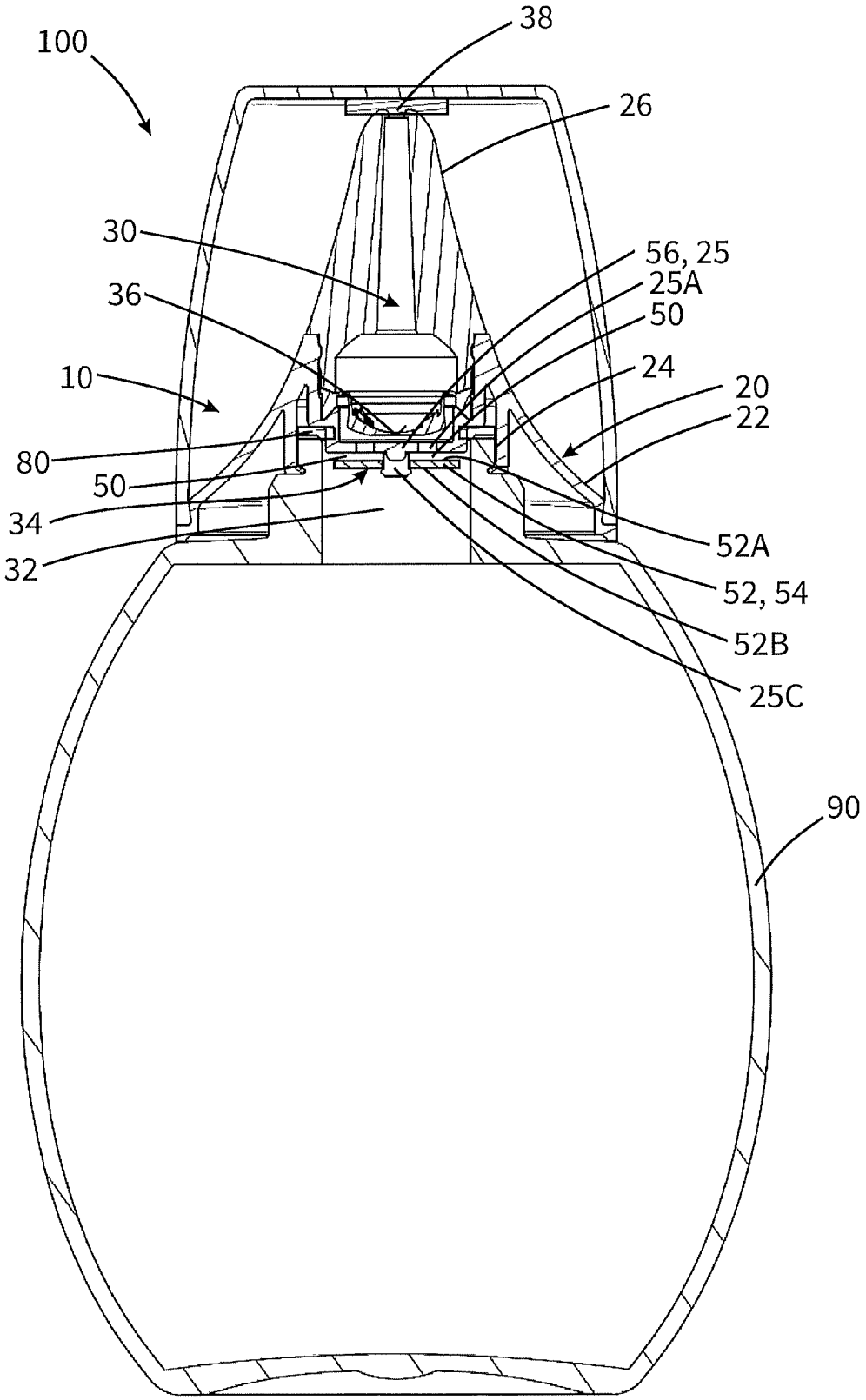
FIG. 2 shows, in a sectioned illustration, a first exemplary embodiment of a liquid dispenser according to the invention.
Figure 3:
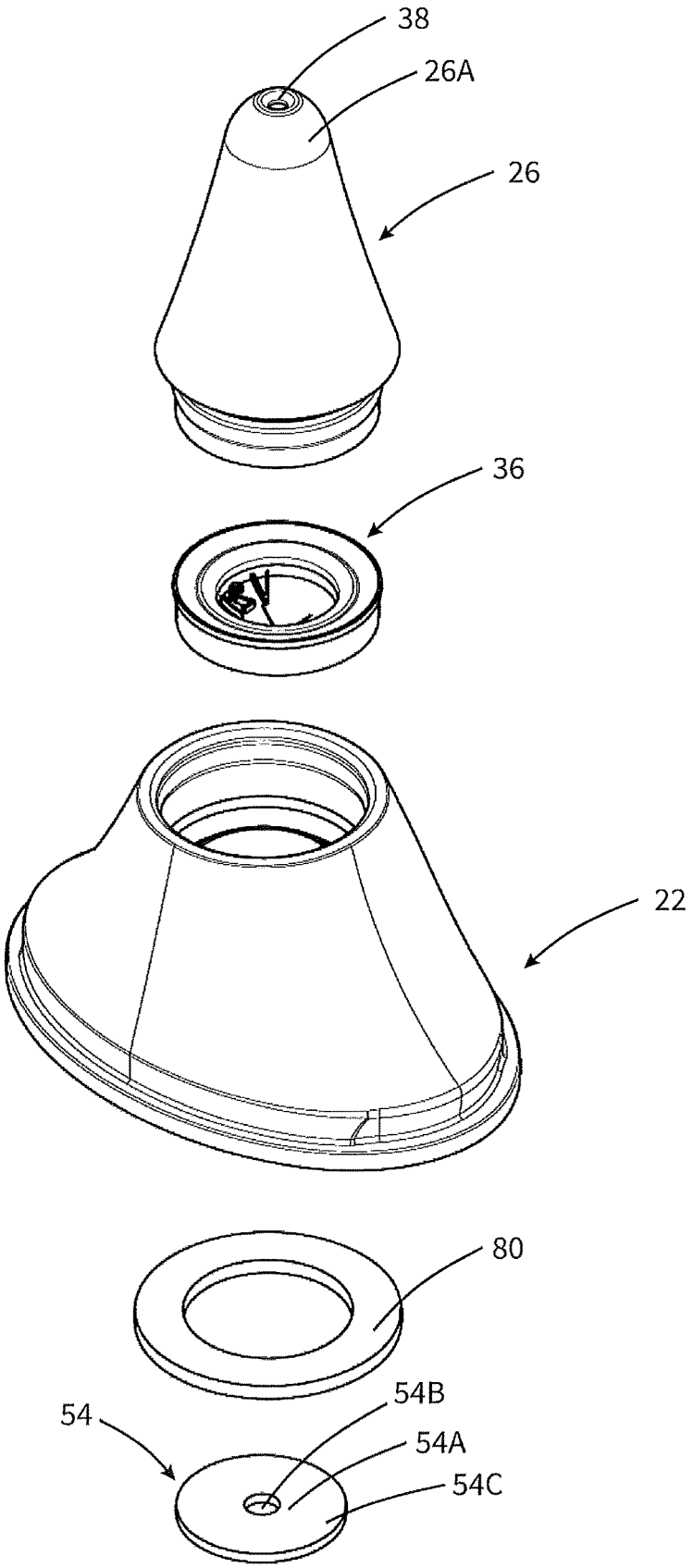
FIG. 3 shows, in an exploded illustration, the sub-components of the discharge head of the first exemplary embodiment.

For this purpose the following exemplary embodiments are described by way of example:

Referring to the configuration illustrated as a sectional illustration in FIG. 2, in connection with a first exemplary embodiment, it can be seen that an outlet channel 30 extends from an inlet region 32, which is adjacent to the interior of the liquid store 90, through two throttle channels 50 of a throttle device 34 and through apertures 25A of the housing 20, up to the region of an outlet valve 36, and further up to the discharge opening 38.

Here, the outlet valve 36 is designed such that it is able to open both in the outlet direction and in the inlet direction with positive pressure and negative pressure, respectively, in the liquid store, so that, following discharge, the outlet channel 30 can also serve as an aeration channel in the reverse direction and allows the liquid to be sucked back from the outlet channel 30. The outlet valve 36 closes if neither positive pressure nor negative pressure in the liquid store 90 with respect to the surroundings prevails, or the positive pressure or the negative pressure does not exceed a limit value. In this way, it is ensured that the risk of inadvertent egress when handling the liquid dispenser 100 is low.

The discharge head 10 has a very simple construction. Beyond the design, discussed in more detail below, of the throttle device 34, the discharge head 10 is constructed from merely three constituent parts, namely from a two-part housing 20, having a base component 22 and an applicator component 26, and from a fastening ring, fixed between said two components, of the outlet valve 36, which valve is designed in the form of a one-piece elastic component. In the exemplary embodiment, there is additionally provided a sealing ring 80 for sealing off the discharge head 10 with respect to the liquid store 90.

The actual special feature of the dispenser lies in the throttle device 34. Said throttle device is, as already stated, intended to prevent a liquid jet from exiting through the discharge opening 38 if the liquid store 90, designed in the form of a squeeze bottle, is actuated too intensely. For this purpose, the throttle device 34 provided in this first exemplary embodiment comprises a separating wall 25, which belongs to the base component 22 and at the same time constitutes a first positionally fixed channel wall 56 of the throttle channel 50. The second, opposite channel wall is formed by the inner side 52A of an elastically deformable wall plate 54, the latter being clipped onto the base component 22 in the region of a fastening pin 25C.

This will be discussed more precisely referring to FIGS. 4A and 4B, which show the base component 22 without, and with, the fastened wall plate 54.

Figure 4A:
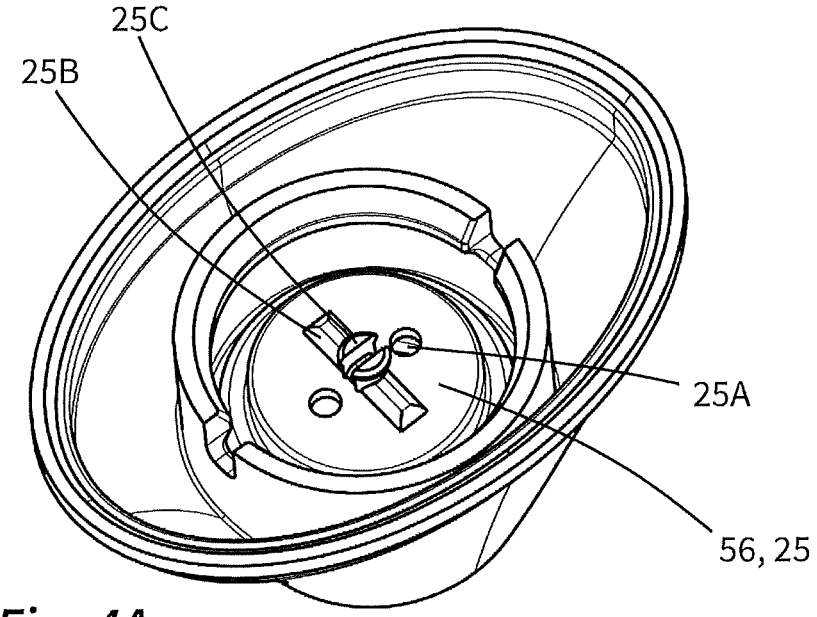
FIGS. 4A and 4B show the inner side of the discharge head as per FIG. 3 with separated and attached flexible wall plate.

On the basis of FIG. 4A, it can be seen that the housing wall 25 is penetrated by two apertures 25A. It can further be seen in FIG. 4A that, in the region of the fastening pin 25C, a bar-like elongate elevation 25B is provided on the separating wall 25 on both sides of the fastening pin 25C. Said elevation separates two throttle channels 50 which are formed by fastening the wall plate 54 to the fastening pin 25C in the manner shown in FIG. 4B.

Again referring to FIG. 2, the functioning is as follows: Starting from the position in FIG. 2, in which the discharge opening 38 points upward, the liquid dispenser 100 is positioned upside-down. There is as yet no risk of liquid discharge as a result of this alone, since the outlet valve 36 is designed not to open as a result of the weight force of the liquid in the liquid store alone. Only when the liquid store 90, which is designed in the form of a squeeze bottle, is compressed does liquid flow from the inlet region 32 into the in each case approximately semi-circular throttle channels 50 in the direction of the apertures 25A, through which the liquid then passes into the region of the outlet valve 36 and further to the discharge opening 38.

If the user then presses on the liquid store 90 in a highly intense manner, then the pressure which acts on the wall plate 54 is also increased. However, said pressure is increased on both sides of the wall plate, and so the pressure increase as such does not yet lead to a relevant deformation of the throttle channels 50. However, if the liquid, under the influence of said pressure, then flows more quickly through the throttle channels 50, then a dynamic pressure is generated here in accordance with Bernouilli's principle. This leads to a force acting on the wall plate 54 which, referring to FIG. 4B, allows the wall plate to bend in slightly in the region of the web, the corresponding bend lines being indicated by dashed lines in said figure. In relation to the perspective in FIG. 2, this bending-in is realized upwardly, with the result that the throttle channels 50 are narrowed. This in turn brings about an increased friction and an energy loss in the liquid, which in turn leads to a reduction in the liquid flow. Instead of the increased pressure thereby resulting in a jet-like discharge, it impedes itself, as it were, so that, despite the increased actuation force, a discharge in drop form is made possible as before.

Figure 4B:
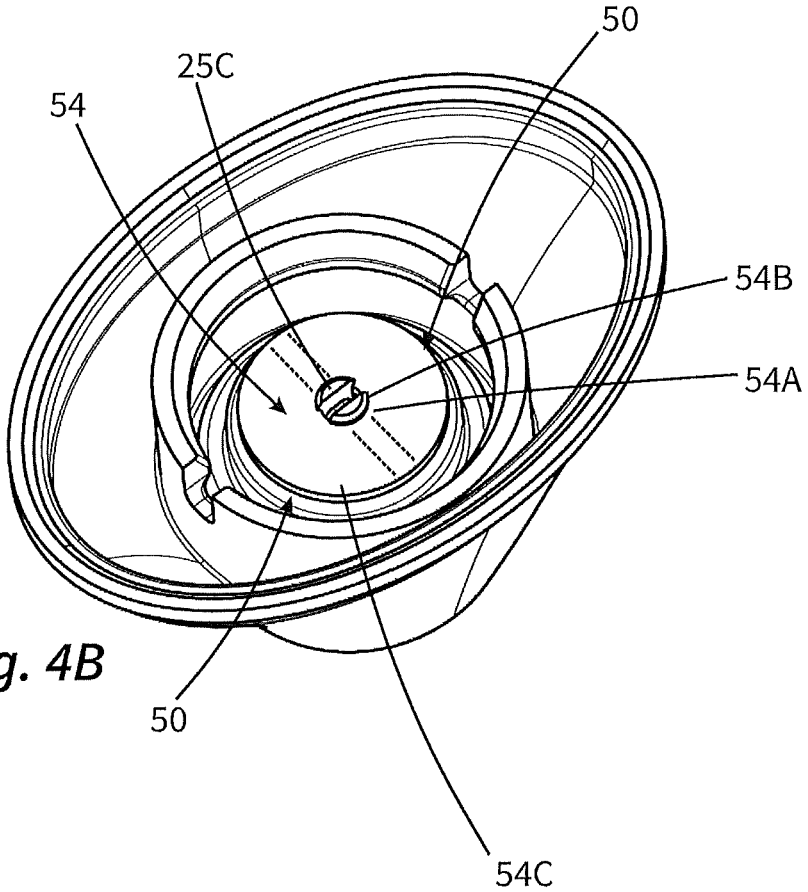
Figure 5A:
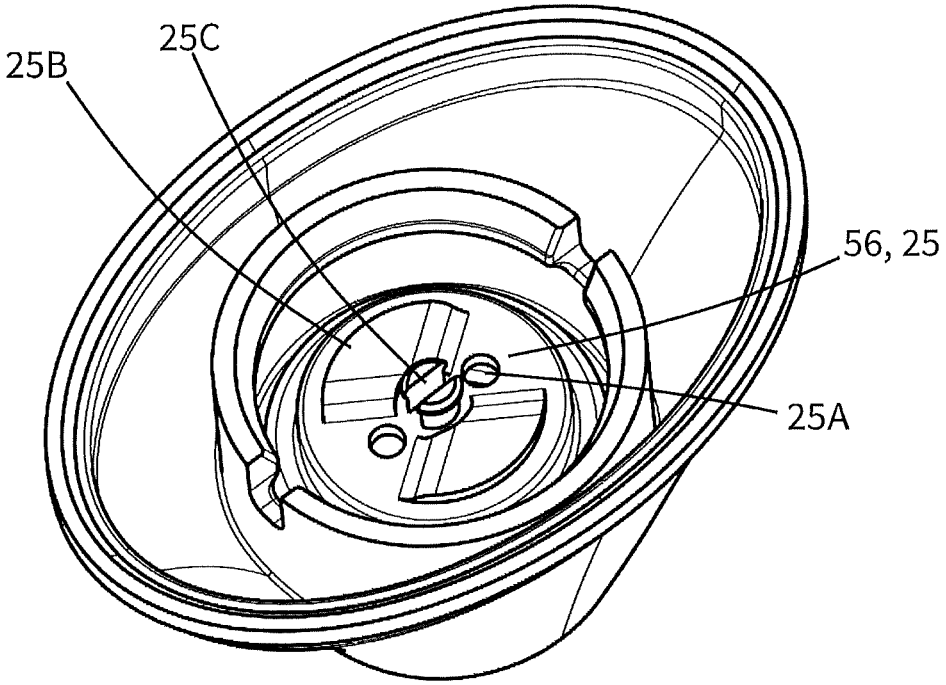
FIGS. 5A and 5B show an alternative design of the discharge head, which has a slightly different geometry in the region of the throttle channel.
Figure 5B:
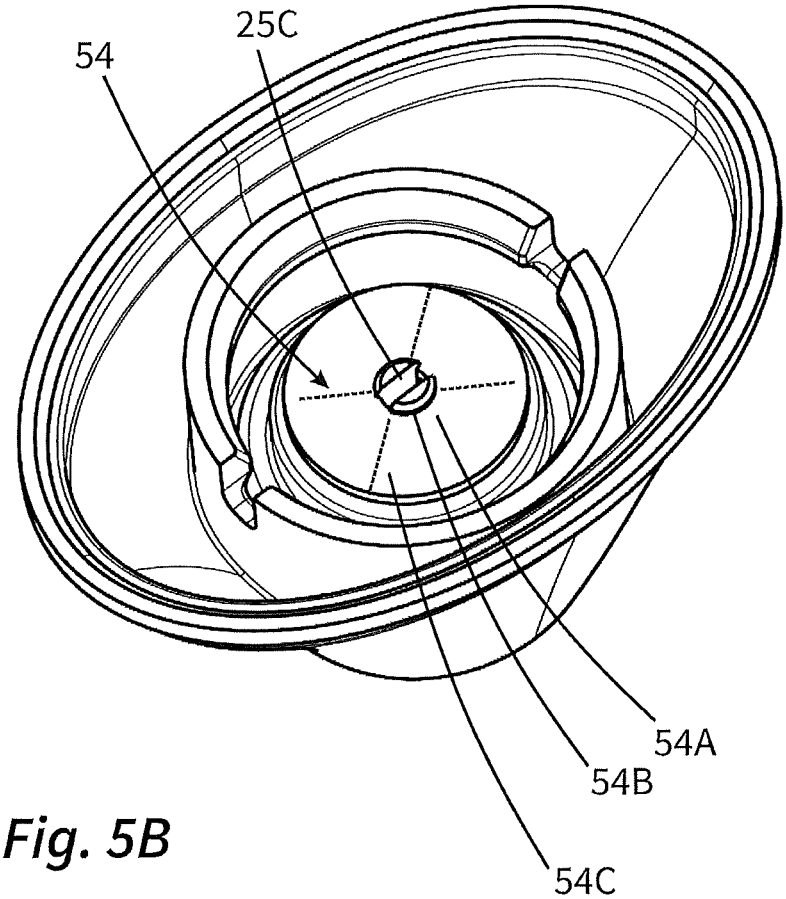

The configuration in FIGS. 5A and 5B is largely similar to that in FIGS. 4A and 4B. The only difference is that, in the case of the design in FIGS. 5A and 5B, the elevations 25B have a different shape and are not, as shown in FIG. 4A, only of elongate, bar-like form. Instead, the elevations have approximately the shape of a quadrant, with the result that the lines illustrated in FIG. 5B, along which the wall plate 54 is deformed as intended, are not in alignment with one another. The effect of this is that the narrowing of the throttle channel takes place under different boundary conditions than in the configuration in FIGS. 4A and 4B. In this manner, it is possible for the liquid dispenser 100 to be adapted for different liquids with a relatively small adaptation.

Figure 6:
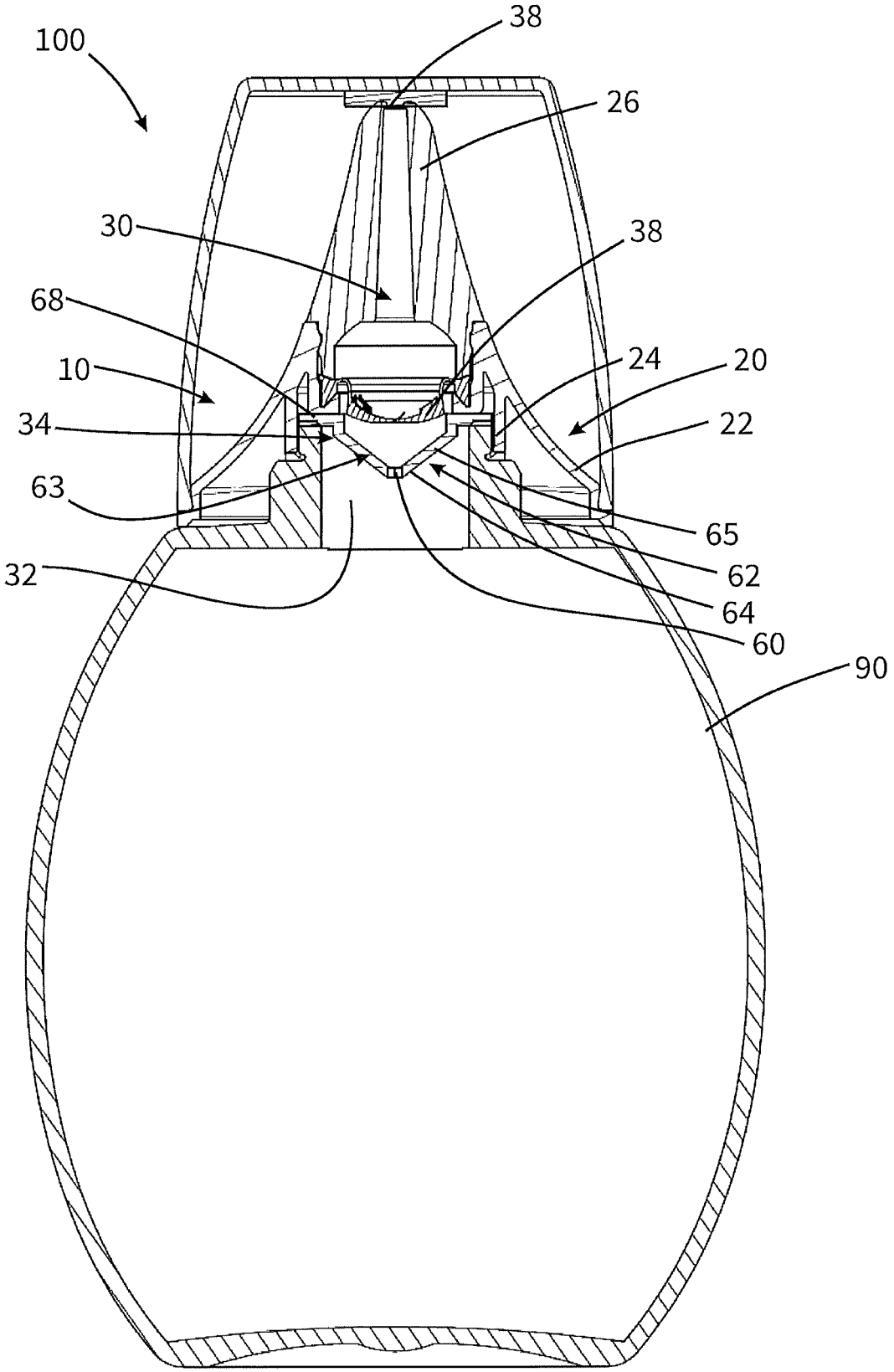
FIG. 6 shows, in a sectioned illustration, a second exemplary embodiment of a liquid dispenser according to the invention.
Figure 7:
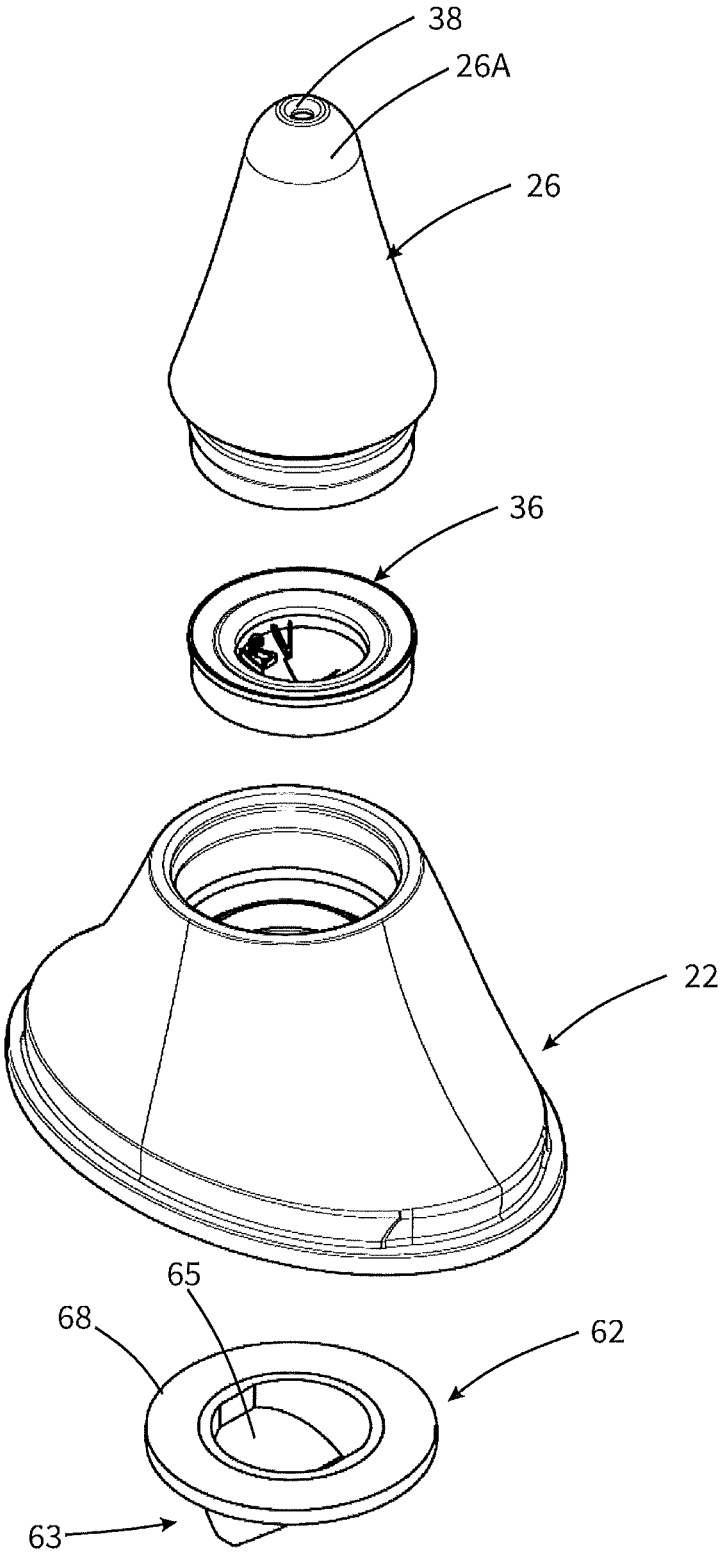
FIG. 7 shows, in an exploded illustration, the sub-components of the discharge head of the second exemplary embodiment.
Figure 8:
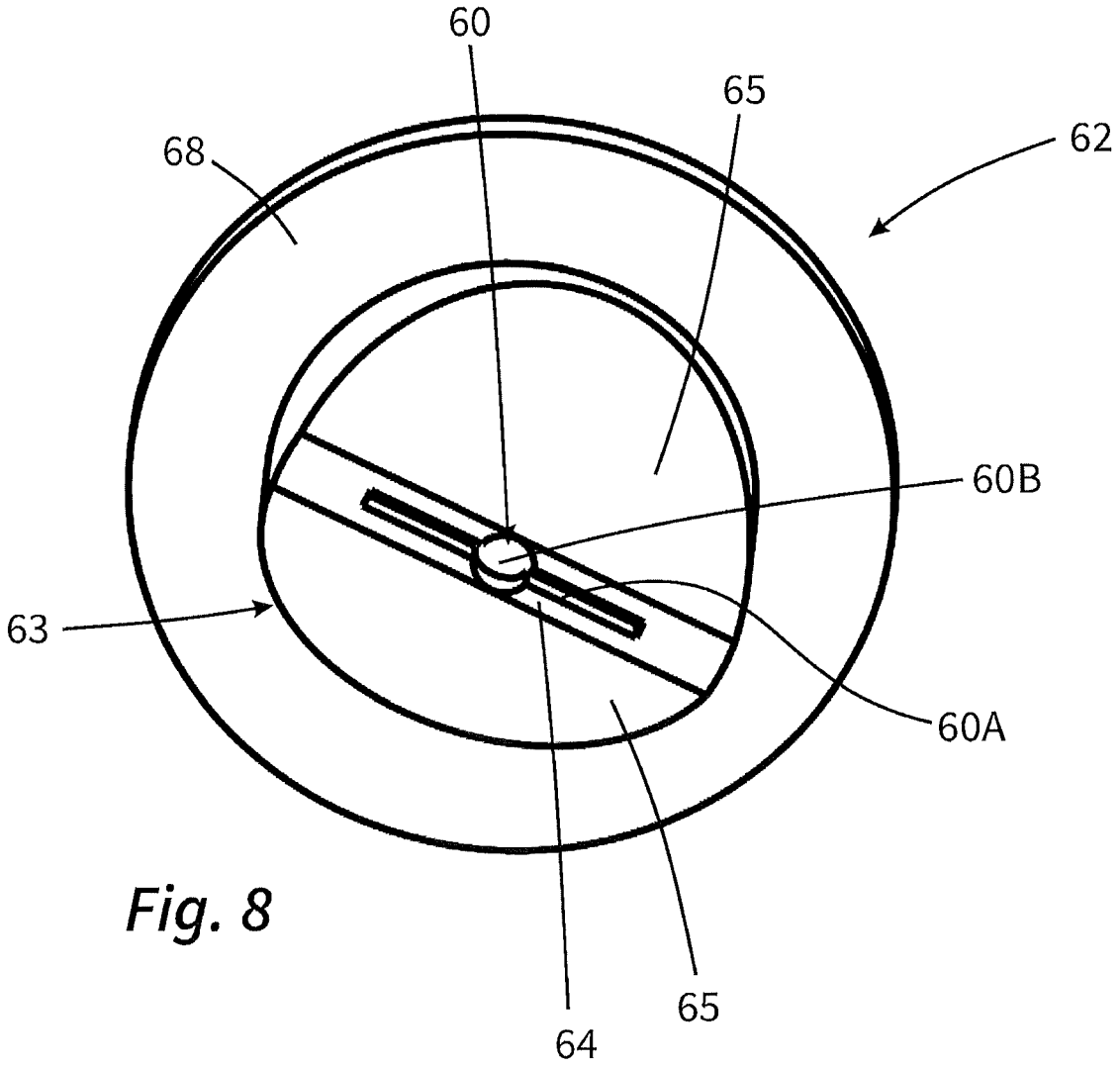
FIG. 8 shows, in a separate illustration, the throttle component of the second exemplary embodiment.

In the configuration as per FIGS. 6 to 8, the throttle device 34 is designed differently.

The throttle device 34 of this embodiment has a throttle component 62 which is elastic as a whole and which is penetrated by the throttle channel 60. Referring to FIG. 8, which displays the throttle component separately, it can be seen that the throttle component 62 has a planar edge region 68, above which an elevation 63 pointing in the direction of the liquid store is raised centrally. The throttle channel 60 penetrates said elevation 63 and is surrounded by a deformation region 64, which deforms as intended. Provided on the elevation are two pressure application surfaces 65 which, when the liquid is discharged, are subjected to pressure by the latter and, in this way, bring about a deformation of the throttle channel 60.

As can likewise be seen in FIG. 8, the throttle channel 60 has a circular free region 60B and slot-like closure regions 60A.

This design is selected so that, when pressure is applied, the throttle channel 60 is not completely closed.

Figure 9A:
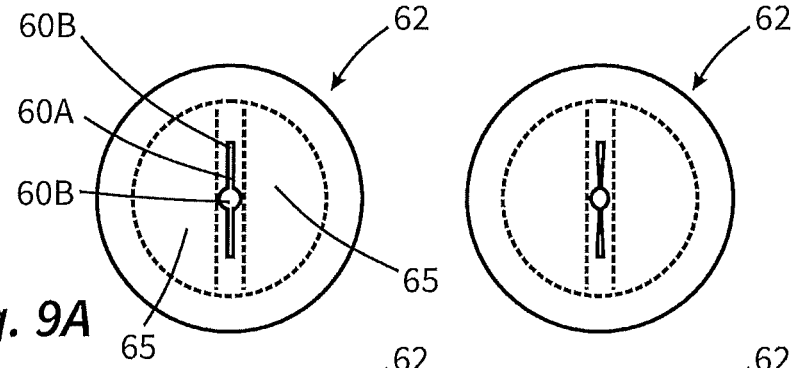
FIG. 9 shows, in a perspective from below, different variants of the throttle component for the exemplary embodiment in FIGS. 6 to 8.

Referring to FIG. 9A, it can be seen that, even with a positive pressure prevailing at the pressure application surfaces 65, only the closure regions 60A are completely closed, while, owing to the shape of the edges, the central circular free region 60B and free regions provided at the ends of the slots remain open. This prevents an excessively intense pressure from causing the discharge to stop completely when actuating the liquid dispenser 100.

Figure 9B:
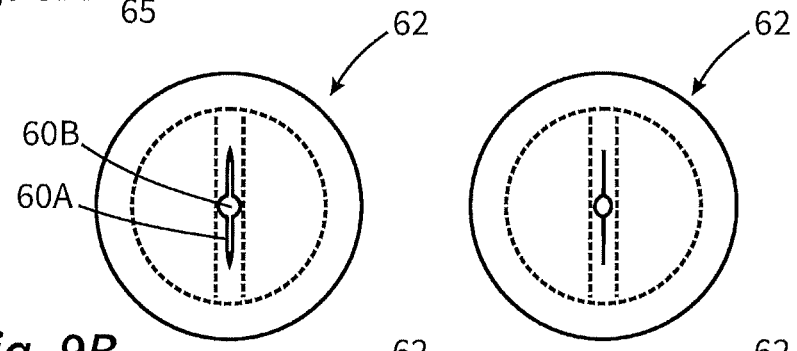
Figure 9C:
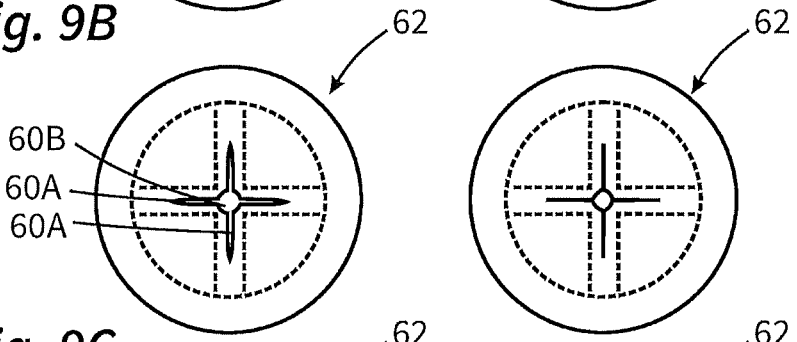
Figure 9D:
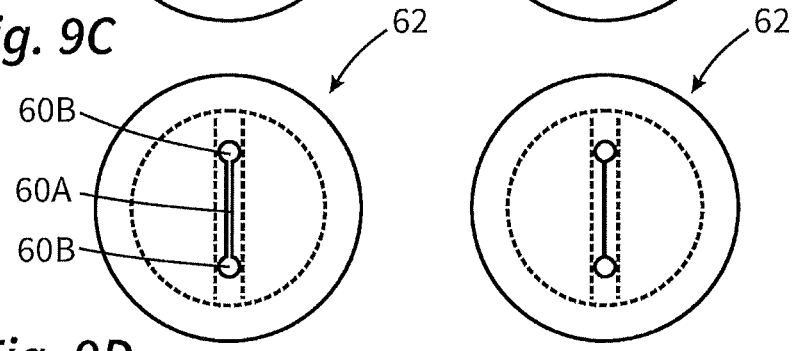

FIGS. 9B to 9D show alternative designs in this respect.

In the configuration as per FIG. 9B, the slot-shaped sub-regions of the throttle channel 60 are shaped such that they permit a complete closure.

In the case of the configuration in FIG. 9C, a cross-shaped slot formation is provided, wherein these slots also completely close when pressure is applied.

In the case of the configuration in FIG. 9D, circular free regions form the ends of the slot.

In all of these configurations, it is in each case provided that free regions 60B and closure regions 60A are part of the same throttle channel 60. This is expedient in particular for liquids which have a tendency to promote adhesion, since the free region remaining permanently open promotes the tendency for the closure regions also to be released from one another again after the discharge process has ended.

Figure 9E:
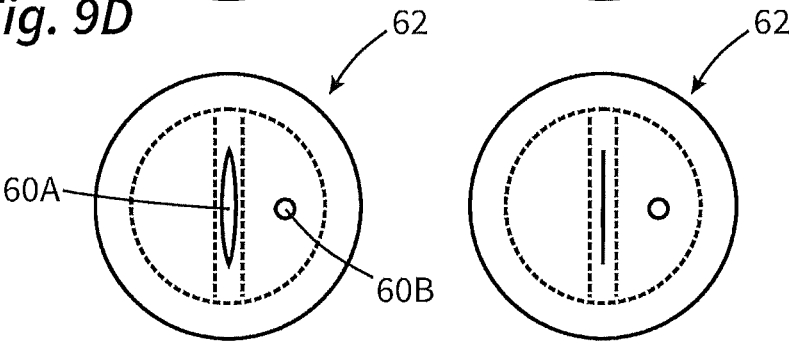

However, as the configuration in FIG. 9E shows, this is not the only option. With this last design of an elastic throttle component, the free region 60B and the closure region 60A are provided in the throttle component 62 in a manner separate from one another.

Figure 10:
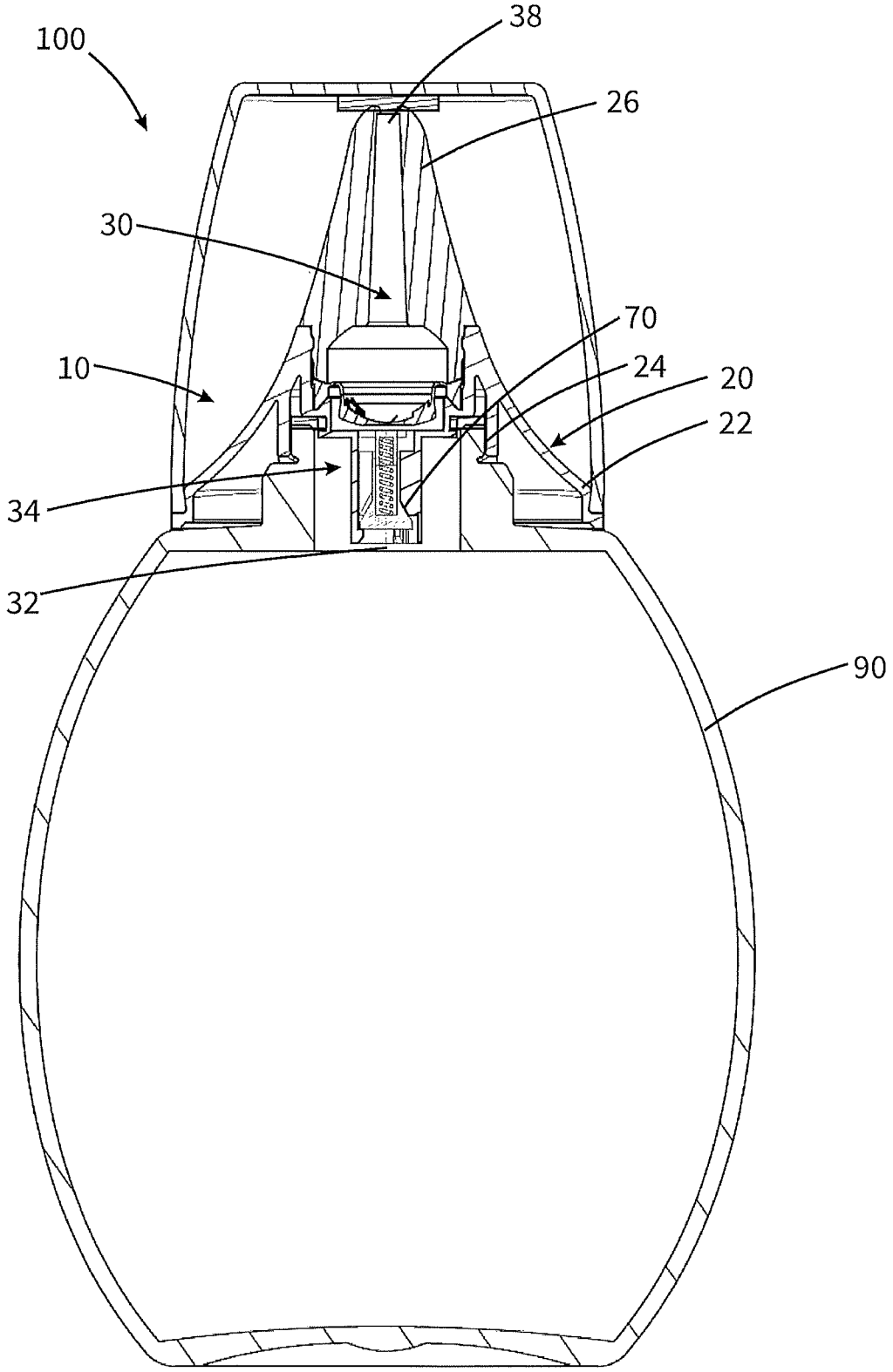
FIG. 10 shows, in a sectioned illustration, a third exemplary embodiment of a liquid dispenser according to the invention.

FIG. 10 and FIGS. 11A and 11B show a third configuration.

Referring to FIGS. 11A and 11B, it can be seen that, here, the throttle channel 70 is adjacent to a displaceable closure body 72, which is subjected to force in the direction of the end position in FIG. 11A via a spring 74 in a sleeve structure 76, 72A. If then a positive pressure is built up in the liquid store 90, then said positive pressure acts on the throttle body 72 on all sides. Owing to the larger effective pressure application surface for application of pressure in the upward direction, the pressure prevailing on all sides acts such that a force acts on the throttle body 72 that, in relation to the perspective in FIGS. 11A and 11B, displaces said body upward.

In this way, the throttle channel 70 is reduced in size with regard to its cross section and a part of the throttle channel 70 is ultimately completely closed. However, the liquid can nevertheless still partially flow past the throttle body 72, with the result that drop formation is still possible.

The invention claimed is:

1. A discharge head for a liquid dispenser, said discharge head comprising:

a housing;

a coupling device configured for attachment to a liquid store;

a discharge opening through which liquid is dispensed into a surrounding atmosphere;

an inlet region disposed to face the liquid store;

an outlet channel extending from said inlet region to said discharge opening to supply said discharge opening with liquid from the liquid store; and a throttle device disposed in said outlet channel, said throttle device having a throttle channel, said throttle channel communicating with, and defining a portion of, said outlet channel such that liquid from the liquid store flowing through said outlet channel flows through said throttle channel, said throttle channel having a cross-section for accommodating liquid therein, said throttle device comprising a throttle channel wall defining a portion of said throttle channel, said throttle channel wall being displaceable or deformable to vary a position of said throttle channel wall within said throttle channel to reduce a size of said cross-section of said throttle channel to a reduced cross-sectional size with an increasing liquid pressure at said throttle device or with an increasing liquid flow through said throttle device, said reduced cross-sectional size of said throttle channel being dimensioned to always permit liquid to flow from the liquid store through said throttle channel and to exit said discharge opening such that said throttle channel never completely closes.

2. The discharge head according to claim 1, wherein said throttle channel wall is displaceable into a first position in which said size of said cross-section of said throttle channel is a minimum size and said throttle channel wall having a second position in which said size of said cross-section of said throttle channel is a maximum size, wherein said said throttle device in said first position of said throttle channel wall permits flow of liquid from the liquid store through said throttle channel and through said discharge opening.

3. The discharge head according to claim 1, wherein said reduced cross-sectional size of said throttle channel permits liquid to flow from the liquid store through said throttle channel and to exit said discharge opening when a maximum liquid pressure or a maximum liquid flow occurs at said throttle device due to an actuation pressure applied to the liquid store.

4. The discharge head according to claim 1, wherein said throttle device comprises a throttle component disposed in said throttle channel, said throttle component defining said throttle channel wall with said throttle channel wall being a first throttle channel wall, said throttle device comprising a second throttle channel wall which together with said first throttle channel wall defines said throttle channel, said throttle component being displaceable within said throttle channel and relative to said second throttle channel wall to reduce said size of said cross-section of said throttle channel.

5. The discharge head according to claim 4, wherein said throttle device comprises a guide element configured to permit linear displacement of said throttle component within said throttle channel and relative to said housing.

6. The discharge head according to claim 4, wherein said throttle component has a non-throttling or minimal throttling position in which said size of said cross-section of said throttle channel is a maximum size, said throttle component being displaceable into a throttling position in which said size of said cross-section of said throttle channel is a size less than said maximum size, said throttle device further comprising a spring disposed between said throttle component and said housing and biasing said throttle component in a direction towards said non-throttling or minimal throttling position.

7. The discharge head according to claim 4, wherein said throttle component comprises pressure application surfaces disposed in said throttle channel such that said pressure application surfaces are positioned to receive a force which displaces said throttle component and reduces said size of said cross-section of said throttle channel.

8. The discharge head according to claim 1, wherein said throttle channel wall has an inner side defining part of said throttle channel and an outer side facing away from said inner side, said outer side being disposed adjacent an inlet of said throttle channel disposed to communicate with said inlet region such that when liquid in the liquid store is subjected to pressure for discharge purposes an identical pressure increase is realized at said inlet of said throttle channel and at said outer side of said throttle channel wall.

9. The discharge head according to claim 1, wherein said throttle device comprises a wall plate and said throttle channel wall is a first channel wall and forms part of said wall plate, and a second channel wall disposed opposite said first channel wall, said second channel wall being non-movable relative to said housing, and said first and second channel walls define said throttle channel therebetween.

10. The discharge head according to claim 9, wherein said second channel wall is formed on said housing, and said wall plate includes a fastening region disposed in a positionally-fixed manner on said housing and a deformable section projecting over said throttle channel approximately parallel to said second channel wall.

11. The discharge head according to claim 10, wherein said second channel wall defines therein at least one aperture and said throttle channel opens into said at least one aperture.

12. The discharge head according to claim 10, wherein said wall plate includes a fastening opening in said fastening region and said housing includes a fastening pin, said fastening opening being snap-fitted to said fastening pin.

13. The discharge head according to claim 9, wherein said throttle channel includes first and second throttle channels, said first and second throttle channels being connected to one another in parallel in terms of flow, and said wall plate defines parts of both said first and second throttle channels.

14. The discharge head according to claim 9, wherein said first channel wall or said second channel wall comprises an elevation thereon, said first channel wall and said second channel wall bearing against one another at said elevation.

15. The discharge head according to claim 1, wherein said throttle device comprises a throttle component composed of an elastically deformable material, said throttle component defining therein an aperture and a deformation region disposed in surrounding relation with said aperture, said aperture forming at least part of said throttle channel, said throttle component comprising at least one pressure application surface downstream of the liquid store and to which liquid from the liquid store applies pressure during operation of said discharge head and deforms said deformation region to reduce said size of said cross-section of said throttle channel.

16. The discharge head according to claim 15, wherein said throttle component comprises an elevation, said elevation being configured to bulge in a direction towards the liquid store and defining a portion of said throttle channel, said aperture being disposed in said elevation.

17. The discharge head according to claim 15, wherein said throttle component comprises a circular edge region integral with said deformation region, said circular edge region being fastened to said housing at a rigid housing section of said housing.

18. The discharge head according to claim 17, wherein said circular edge region is disposed on said discharge head in a position so as to seal off the liquid store when the liquid store is coupled to said discharge head.

19. The discharge head according to claim 15, wherein said deformation region of said throttle component comprises at least one closure region having opposite edges which bear against one another as a result of pressurization of said at least one pressure application surface, and said aperture is configured so as not to close as a result of pressurization of said at least one pressure application surface.

20. The discharge head according to claim 1, further including an outlet valve disposed in said outlet channel between said discharge opening and said throttle device, said outlet valve being configured to open based on a positive pressure prevailing upstream of said outlet valve.

21. The discharge head according to claim 20, wherein said outlet valve is configured to close automatically in a pressure interval between a defined inlet-side negative pressure and a defined inlet-side positive pressure and is configured to open when said defined inlet-side negative pressure is exceeded and when said defined inlet-side positive pressure is exceeded, said outlet valve comprising an elastic material and comprising a bulge projecting towards the liquid store and having a valve opening closable by valve lips, said valve lips, with increasing inlet-side positive pressure, being increasingly pressed against one another by said increasing inlet-side positive pressure up to an attainment of an inlet-side limit pressure for positive pressure.

22. The discharge head according to claim 20, wherein said housing comprises a base component on which said coupling device is disposed and an applicator component fastened to said base component and defining said discharge opening, said outlet channel penetrating said applicator component, said outlet valve being fixed in position between said base component and said applicator component.

23. The discharge head according to claim 1, wherein said discharge head comprises a drop formation surface disposed in surrounding relation with said discharge opening, and said throttle device is configured for limiting a flow of liquid from the liquid store such that single drops are formed at said discharge opening.

24. A liquid dispenser for dispensing cosmetic or pharmaceutical liquids, said liquid dispenser comprising:

a liquid store; and a discharge head having a housing formed integrally with or detachably coupled to said liquid store, said discharge head comprising:

a discharge opening through which liquid is dispensed into a surrounding atmosphere;

an inlet region disposed to face said liquid store;

an outlet channel extending from said inlet region to said discharge opening to supply said discharge opening with liquid from the liquid store; and a throttle device disposed in said outlet channel, said throttle device having a throttle channel, said throttle channel communicating with, and defining a portion of, said outlet channel such that liquid from the liquid store flowing through said outlet channel flows through said throttle channel, said throttle channel having a cross-section for accommodating liquid therein, said throttle device comprising a throttle channel wall defining a portion of said throttle channel, said throttle channel wall being displaceable or deformable to vary a position of said throttle channel wall within said throttle channel to reduce a size of said cross-section of said throttle channel to a reduced cross-sectional size with an increasing liquid pressure at said throttle device or with an increasing liquid flow through said throttle device, said reduced cross-sectional size of said throttle channel being dimensioned to always permit liquid to flow from the liquid store through said throttle channel and to exit said discharge opening such that said throttle channel never completely closes.

25. The liquid dispenser according to claim 24, wherein said liquid dispenser is configured as a drop dispenser, and/or said liquid store is configured as a squeeze bottle or a tube, and/or an inner volume of said liquid store is less than 300 ml, and/or said liquid store is filled with a cosmetic or pharmaceutical liquid.

26. A discharge head for a liquid dispenser, said discharge head comprising:

a housing configured for cooperation with a liquid store;

a discharge opening through which liquid is dispensed into a surrounding atmosphere;

an inlet region disposed to receive liquid from the liquid store;

an outlet channel configured to provide fluid communication between said discharge opening and said inlet region;

an outlet valve disposed in communication with said outlet channel, said outlet valve having an open configuration and a closed configuration, said outlet valve in said open configuration permitting discharge of liquid in said outlet channel to exit said discharge opening and said outlet valve in said closed configuration preventing discharge of liquid in said outlet channel from exiting said discharge opening; and a throttle device disposed in said outlet channel and upstream, with respect to a fluid-flow direction of liquid from said inlet region towards said discharge opening, of said outlet valve, said throttle device having a throttle channel forming a portion of said outlet channel and having a cross-section configured for receiving liquid therein, said throttle device comprising a throttle channel wall defining a portion of said throttle channel, said throttle channel wall being configured for displacement or deformation within said throttle channel to reduce a size of said cross-section of said throttle channel and maintain an intended form of release of liquid from said discharge opening when said outlet valve is in the open configuration, said throttle channel wall being displaceable or deformable into a first position in which said size of said cross-section of said throttle channel is a minimum size, said throttle channel wall having a second position in which said size of said cross-section of said throttle channel is a maximum size, and said throttle device is configured such that when said throttle channel wall is in said first position, said throttle device permits flow of liquid from the liquid store through said throttle channel and through said discharge opening.

27. The discharge head according to claim 26, wherein a maximum displacement or a maximum deformation of said throttle channel wall permits flow of liquid from the liquid store through said throttle channel and through said discharge opening.

* * * * *